US005271628A

United States Patent [19]

Okada

[11] Patent Number: 5,271,628

[45] Date of Patent: Dec. 21, 1993

[54] CRANE GAME MACHINE

[75] Inventor: Kazuo Okada, Oyama, Japan

[73] Assignee: Universal Co., Ltd., Oyama, Japan

[21] Appl. No.: 501,740

[22] Filed: Mar. 30, 1990

Related U.S. Application Data

[63] Continuation of Ser. No. 197,332, May 20, 1988, abandoned.

[30] Foreign Application Priority Data

May 30, 1987 [JP] Japan ..... 62-135934

[51] Int. Cl.[5] ..... A63F 9/00

[52] U.S. Cl. ..... 273/448; 221/210

[58] Field of Search ..... 273/1 GC, 1 GG; 221/210

[56] References Cited

U.S. PATENT DOCUMENTS 2,600,849 6/1972 Collins et al. ..... 221/210 X

*Primary Examiner*—Paul E. Shapiro

*Attorney, Agent, or Firm*—Staas & Halsey

[57] ABSTRACT

A crane game machine which includes a premium article placing face for putting a large number of premium articles thereon, a crane having a plurality of hooks for grasping a premium article, and a driving mechanism for setting the crane to a position on the premium article placing face and for making the crane hooks grasp a premium article in response to a starting operation by an operator. A grasping force is changed by changing the weight of the crane. The probability of gaining the premium article can be regulated in a recreation hall or the like where the game machine is handled by varying the weight of the crane.

7 Claims, 7 Drawing Sheets

CRANE GAME MACHINE

This is a continuation of copending application Ser. No. 07/197,332 filed on May 20, 1988, now abandoned.

BACKGROUND OF THE INVENTION

1. Field of the Invention

The present invention relates to a crane game machine having a crane type premium article-grasping means which can be moved by an operation of a player who plays a game of grasping a premium article such as a toy, a candy or the like.

2. Description of the Related Art

As the conventional crane game machine, there have been known those having a premium article placing face for putting a large number of premium articles, a crane as a premium article grasping means having a plurality of hooks and a driving mechanism disposed in a housing which has a transparent cover, and an inlet for inserting coins therethrough. A manipulating portion includes a starting switch and other controls disposed on the outside face of the housing to be operated by a player. When the game is played, a player inserts a coin and operates the manipulating portion to move the crane to a desired position on the premium article placing face to grasp a premium article. When the hooks grasp well the premium article, the premium article is taken out so that the player can keep it. As to such a game machine the period and number of times the player is permitted to play a game per coin insertion are previously decided.

In the conventional crane game machine, however, even if tips of the hooks can touch a desired premium article, it depends on random factors whether the article can be grasped and lifted up. The reason is that the premium articles on the placing face have various shapes and are positioned variously, whereas the grasping force of the hooks is constant and the premium article cannot be gained unless the hooks come into a state such that they hold the premium article therein. Therefore, in many cases, the game is over for the player without gaining any premium article. As the result, at a recreation hall, a problem arises in that players tend not to play with the crane game machine. Accordingly, there is a need to raise a ratio or probability of gaining such a premium article, but as to the conventional crane game machine, the force of the hooks for catching a premium article is constant as mentioned above. Thus, there is a problem that it is impossible to increase the chance that the hooks grasp well a premium article and carry the same out.

SUMMARY OF THE INVENTION

An object of the present invention is to provide a crane game machine which is capable of regulating the ratio or probability of gaining a premium article by making the premium article grasping force of the crane hooks changeable.

According to the present invention, there is provided a crane game machine which comprises a premium article placing face for putting a large number of premium articles thereon, a crane having a plurality of hooks for grasping at least one of the premium articles, a driving mechanism for setting the crane to a position on the premium article placing face and for making the hooks of the crane grasp at least one of the premium articles in response to the operation for initiating the movement by an operator, and a grasping force changing means for changing the premium article grasping force of the crane hooks.

According to the crane game machine constituted as mentioned above, the driving mechanism moves the crane to a position on the premium article placing face and closes the plurality of hooks. When the hooks grasp well the premium article, the player can gain the premium article. When the grasping force changing means sets up the grasping force of the crane hooks relatively small, the ratio or probability of gaining premium article is low, while when the grasping force changing means sets up the grasping force of the crane hooks large, the ratio or probability of gaining premium article becomes high.

DETAILED DESCRIPTION OF THE PREFERRED EMBODIMENT

Figure 1:
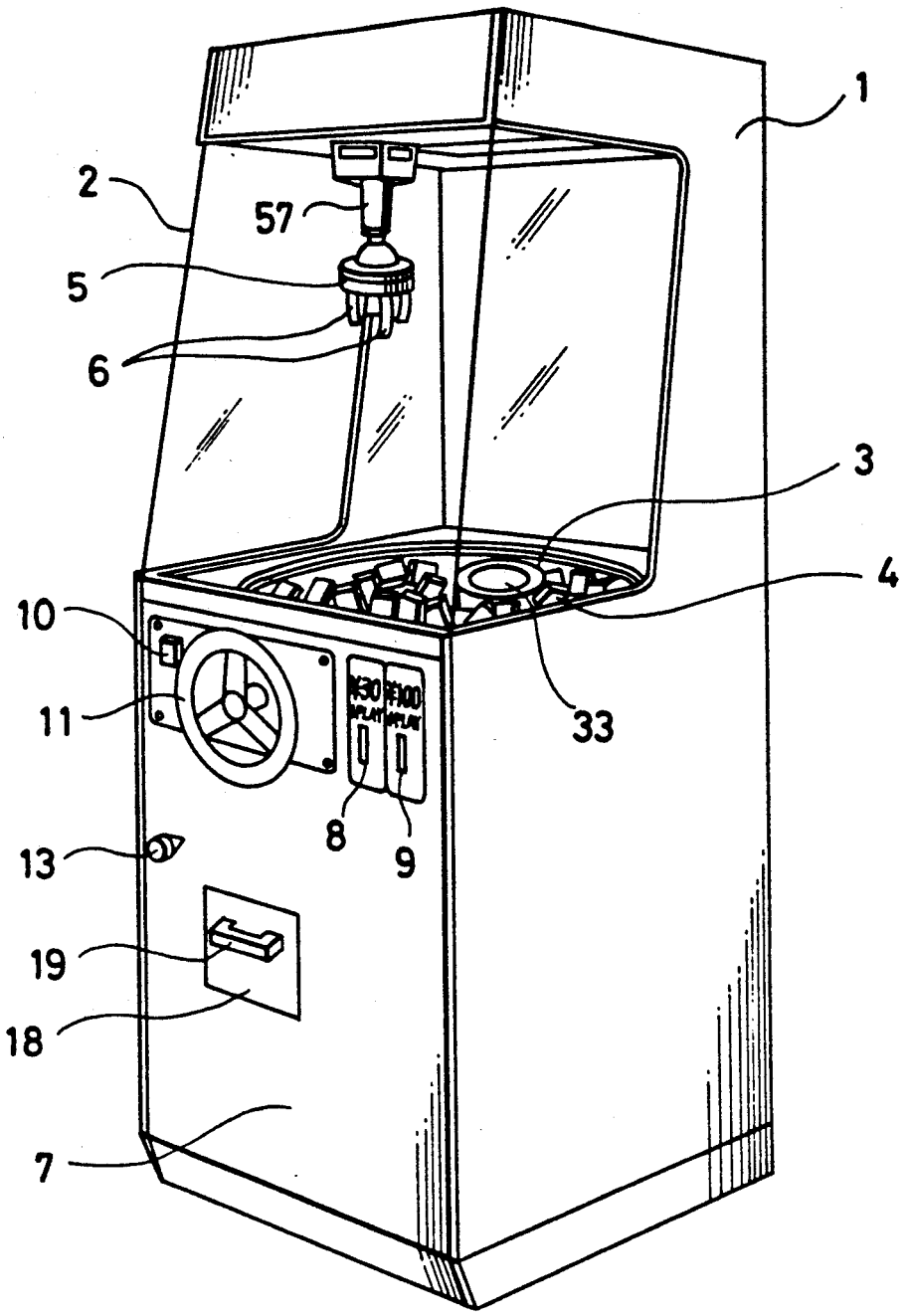
FIG. 1 is a perspective view showing a preferred embodiment of a crane game machine according to the present invention.

FIG. 1 is a perspective view showing an appearance of a crane game machine constituted so as to put a large number of premium articles on a turntable disposed in a housing. The crane game machine has a box-type housing 1, which has a transparent glass plate 2 fixed at a front, right and left sides of an upper part thereof so as to see inside therethrough. Inside of the housing 1, there is disposed a disc-type turntable 3 at almost same height as a lower end of the glass portion 2. On an upper surface of the turn table 3 are placed a large number of premium articles 4. Above the turn table 3, a crane 5 is hung. The crane 5 has four hooks 6 which extend downwardly. As mentioned in detail later, the crane 5 is driven up and down by a driving mechanism accommodated in an upper portion of the housing 1. The hooks 6 are opened and closed synchronously with up and down movement of the crane 5.

Figure 2:
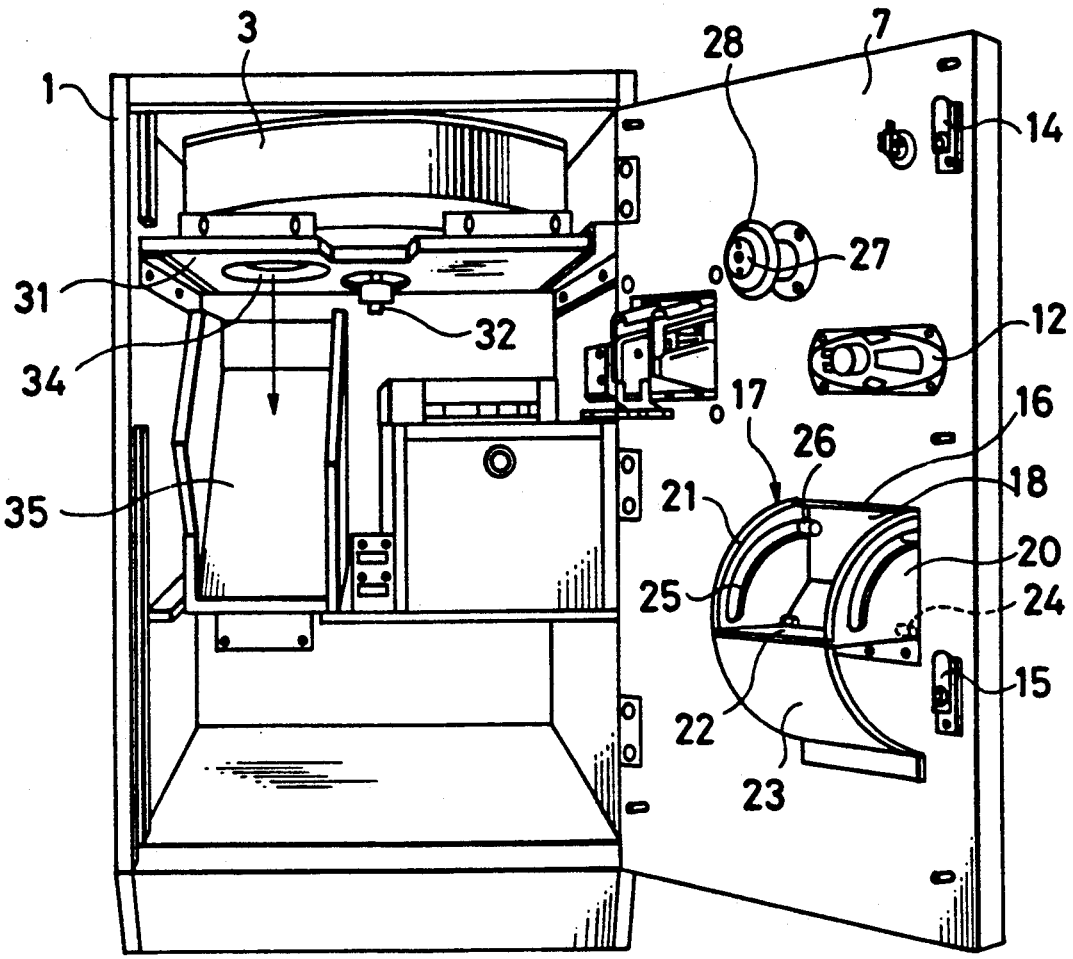
FIG. 2 is a view showing a state where a front door is opened in the embodiment of FIG. 1.

A lower portion of the front of the housing 1 under the glass 2 is provided with a door 7 openable by pivoting to the right side as shown in FIG. 2. The door 7 is provided at an upper portion thereof with two coin insertion inlets 8 and 9, a starter switch 10 as a manipulating portion to be operated by a player when the game starts, and a handle 11 for rotating the turntable 3 by hand as mentioned later. These are attached so as to be operable from outside. In this embodiment, the number of times one is able to play the game per coin insertion is set at two kinds, once and a plurality of times, for example, four times. In order to enable the player to select either of them, two coin insertion inlets 8 and 9 are provided. At the time of playing the game, by inserting a predetermined number of coins into one of the inlets, a coin detector provided inside is actuated and a controller of the game machine is set up so as to play the game once or a plurality of times. Also, in this game machine, there is disposed at a position lower than the starter switch 10 a speaker 12 for generating predetermined effective sound during the movement of the crane.

The door 7 has a knob 13 attached to a central portion of the left side. When the knob 13 is turned under the state where the door 7 is closed, a pair of up and down safety catches 14 and 15 provided on a rear face of the door 7 as shown in FIG. 2 are turned to lock or unlock the door. Further, the door 7 has a rectangular opening 16 disposed at the center for taking out a premium article grasped by the crane 5 as mentioned later. The opening 16 is closed with a cover plate 18 of a premium article receptor member 17 attached on the rear face of the door 7. Also, the cover plate 18 is provided with a grip 19 on its outside.

As shown in FIG. 2, the premium article receptor member 17 consists of the opening cover plate 18 positioned at the front, semi-circular side plates 20 and 21 extending perpendicularly rearwardly from both ends of the cover plate 18. A bottom plate 22 is inclined downwardly from a lower end of the cover plate 18 and extruding along lower edges of both of the right and left side plates 20 and 21. A stopper plate 23 is archedly curved downward from a rear edge of the bottom plate 22. The premium article receptor member 17 is attached to the door 7 freely rotatably in a direction perpendicular to the door 7 by a pair of hinge pins 24 provided on the rear face of the door 7 at angles of the right and left side plates 20 and 21. Moreover, each of the right and left side plates 20 and 21 has an arched cutout 25 in which a guide pin 26, which extends into the opening 16 of the door 7 slidably fits. The cutout 25 acts as a guide when the premium article receptor member 17 is moved rotatively.

The premium article receptor member 17 has a function to close the opening 16 by the cover plate 18 when the end of the stopper plate 23 extending downward abuts on the rear face of the door 7 as shown in FIG. 2. Another function is to receive and hold the premium article which has been grasped and taken out by the crane 5 as mentioned later, at the bottom plate 22. In this state, if the grip 19 is pulled from outside of the door 7, the premium article receptor member 17 is rotated to uncover the opening 16 so that the player can take out the premium article.

Figure 3:
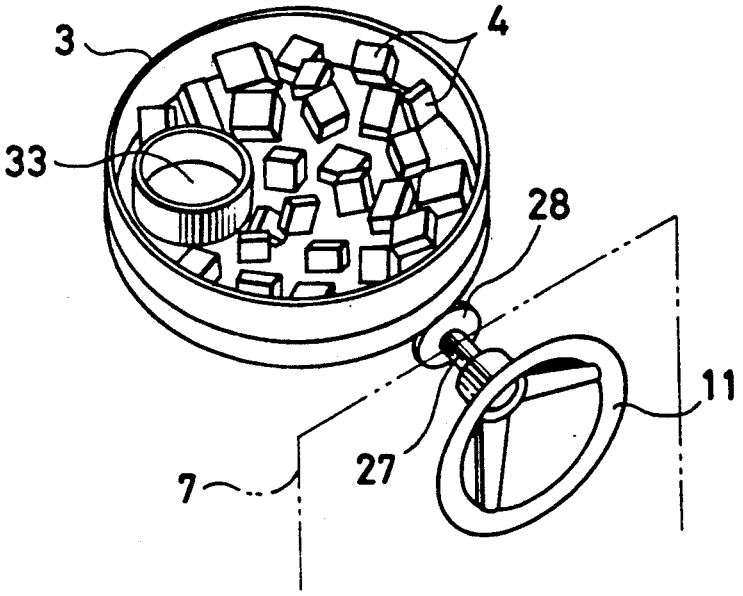
FIG. 3 is a view showing a state of a turntable interlocking to a handle in the embodiment of FIG. 1.

Next, the means for rotating the turntable 3 when the player operates the handle 11 is illustrated with reference to FIGS. 2 and 3. The handle 11 has a shaft 27 acting as a center of rotation, which penetrates through the door 7. A frictional roll consisting of a roller 28 made of a highly frictional material such as rubber, is provided at the end. On the other hand, the turntable 3 is mounted rotatably on a base 31 which can be pulled out to the front side from the inside of the housing 1 when the door 7 is opened. The base 31 is partly cut out at a front edge. In the state where the door 7 is closed after the base 31 equipped with the turntable 3 is accommodated in the housing 1, as shown in FIG. 3, the roller 28 rotating with the handle 11 as one body is positioned at the cutout portion of the base 31 and abuts on the fringe of the lower face of the turntable 3. Therefore, if the handle 11 is rotated, the turn table 3 is rotated due to friction with the roller 28. However, if the handle 11 is rotated quickly, slip is generated around the roller 28, resulting in impossibility for the turntable 3 to follow the rotation of the roller 28. Thus, the positioning of the turntable 3 relative to the crane 5 becomes more difficult and hence, the amusement of the game can be enhanced.

The turntable 3 has an opening 33 on its circular face for discharging the premium article 4 grabbed by the hooks 6 of the crane 5 and correspondingly the base 31 has an opening 34. Further, in the housing 1, under the opening 34 of the base 31 is formed a passage 35 for leading the premium article 4 to the bottom plate 22 of the premium article receptor member 17 mentioned above.

Figure 4:
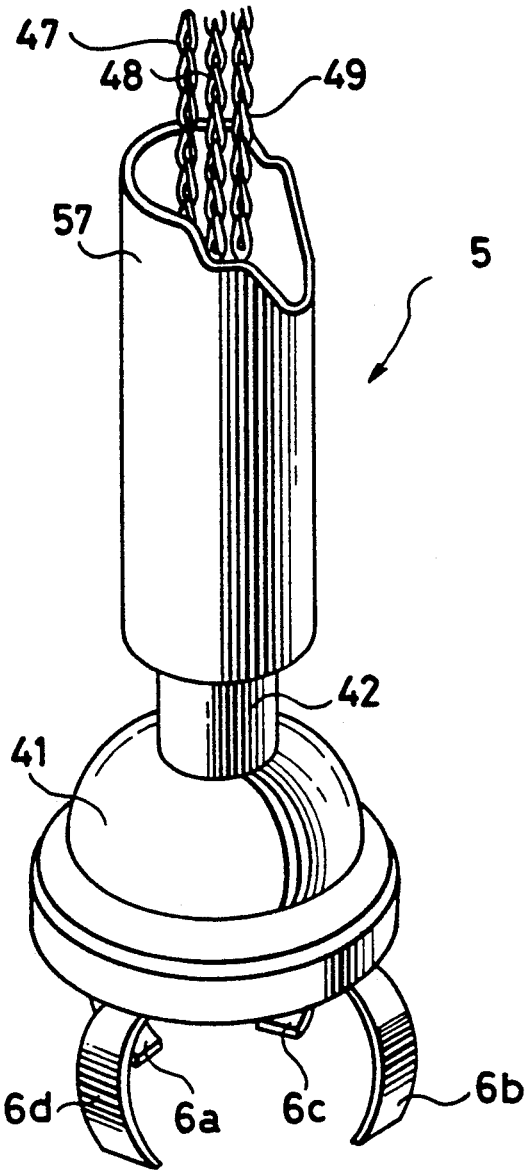
FIG. 4 is a perspective view of a crane portion of the crane game machine of FIG. 1.

Referring to FIG. 4, the crane 5 has a domed casing 41 accommodating four hooks **6*a*, 6*b*, 6*c* and 6*d* freely openably and closeably, each two of which are faced each other, as shown in FIGS. 4 to 6. A top portion of the casing 41 is formed as a cylinder 42, which is provided at diametrically opposite sides with a pair of projections 43*a* and 43*b*, each of which has a perforation. A pair of rings 44*a* and 44*b* passed through the perforations of the projections 43*a* and 43*b*, respectively, are connected to another pair of rings 46*a* and 46*b* through small rings 45*a* and 45*b*. Also, an end of a first chain 47 is connected to the pair of rings 46*a* and 46*b***.

A second chain 48 is connected to an upper end of a movable member 50 accommodated in the casing 41 freely movably up and down. A lower end of the movable member 50 extends radially outwardly in four directions. To the four radial outward end portions are pivotally connected projecting points extending almost rectangularly from the bases of the hooks **6*a* to 6*d*, respectively, by hinge pins 51. The bases of the hooks 6*a* to 6*d* are connected to ends of connector rods 53 by hinge pins 52, and other ends of the connecting rods 53 are connected to the casing 41 by hinge pins 54, respectively. The lower end of the cylinder portion 42 extends downwardly inside of the casing 41**.

A third chain 49 is connected to an upper end of a cylindrical weight member 55 positioned above the casing 41 by a pair of rings **56*a* and 56*b*. The third chain 49 is set up in the state where the weight member 55 is kept above the casing 41 or put on the casing 41 by a solenoid provided as a grasping force changing means which can change the force that the hooks 6 of the crane 5 grasp the premium article 4**, as mentioned later.

The above-mentioned three chains 47, 48 and 49 are pass upwardly through a cylinder 57 hung from the inner ceiling of the housing 1 as shown in FIGS. 1 and 4 and are connected to a driving mechanism 60 (FIG. 7) accommodated in the upper part of the housing 1.

Figure 7:
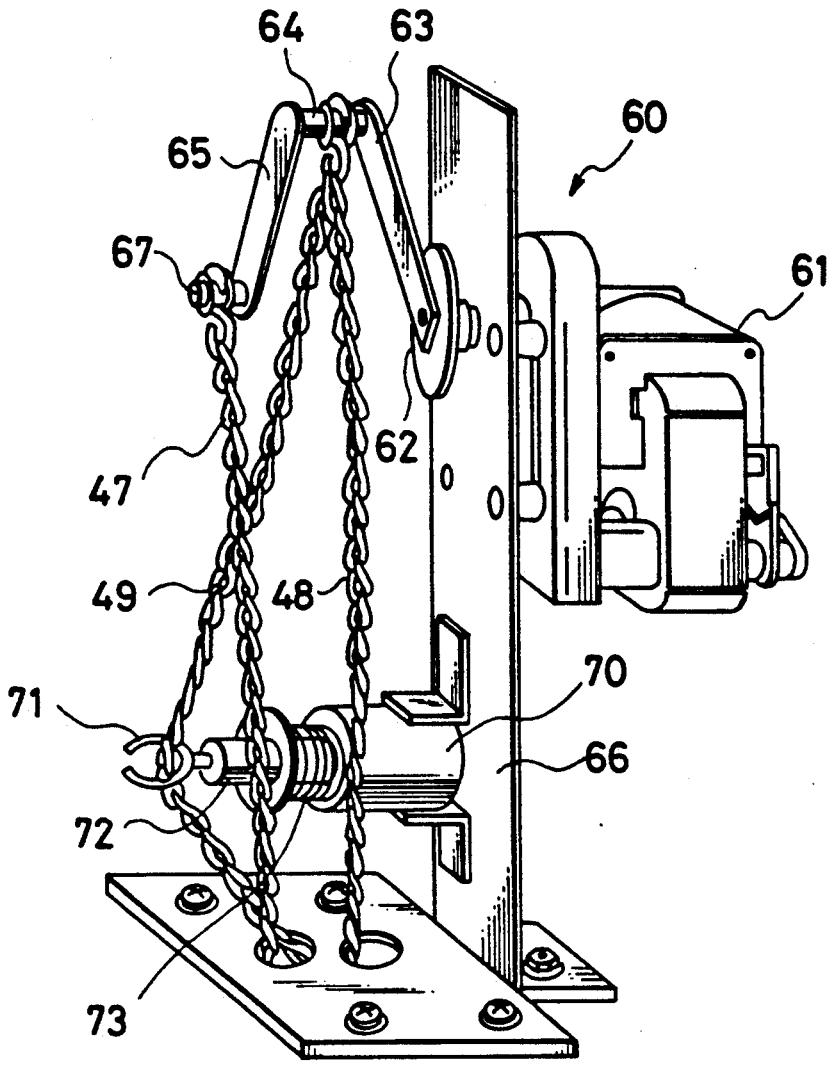
FIG. 7 is a perspective view showing a driving mechanism of the crane game machine of FIG. 1.

As shown in FIG. 7, the driving mechanism 60 comprises a rotation power unit 61 including a motor and driving gears, a first link 63 which is fixed at one end to a rotation output shaft 62 of the rotation power unit 61, and a second link 65 which is connected to the first link 63 so as to form an almost L-shape by a connecting rod 64 provided at another end of the first link 63. The driving mechanism 60 is fixed to a vertical mounting plate 66 attached in the upper portion of the housing 1. An upper end of the first chain 47, which is connected to the casing 41 of the crane 5 as mentioned above, is connected to a free end of the second link 65 by a second connecting rod 67, while upper ends of the second chain 48 and the third chain 49 are connected to the first connecting rod 64 by which the two links 63 and 65 are connected in L-shape. It also should be noted that the upper end of the third chain 49 may be connected to a second connecting rod 67.

To the mounting plate 66 of the driving mechanism 60 mentioned above is attached a solenoid 70 as the grasping force changing means for changing the premium article grasping force of the hooks of the crane 5. The solenoid 70 has a plunger 72 equipped at its distal end with a hook 71 which is engaged with the third chain 49. A spring 73 biases the plunger 72 outwardly when the solenoid 70 is not electrically supplied. The solenoid 70 is electrically supplied from a predetermined electric source via a manual switch or a drive control circuit (not shown). In the state where the plunger 72 is extruded as shown in FIG. 7, the hook 71 of the top of the plunger 72 pushes the third chain 49 to impart tension, thereby keeping the weight member 55 above the casing 41 by the third chain 49, as shown in FIG. 5. On the other hand, when the solenoid 70 is electrically supplied, the plunger 72 is moved back against the counterforce of the spring 73 to release the tension of the third chain 49. Accordingly, as shown in FIG. 6, the weight member 55 is put on the casing 41 to add a weight thereto.

Figure 5B:
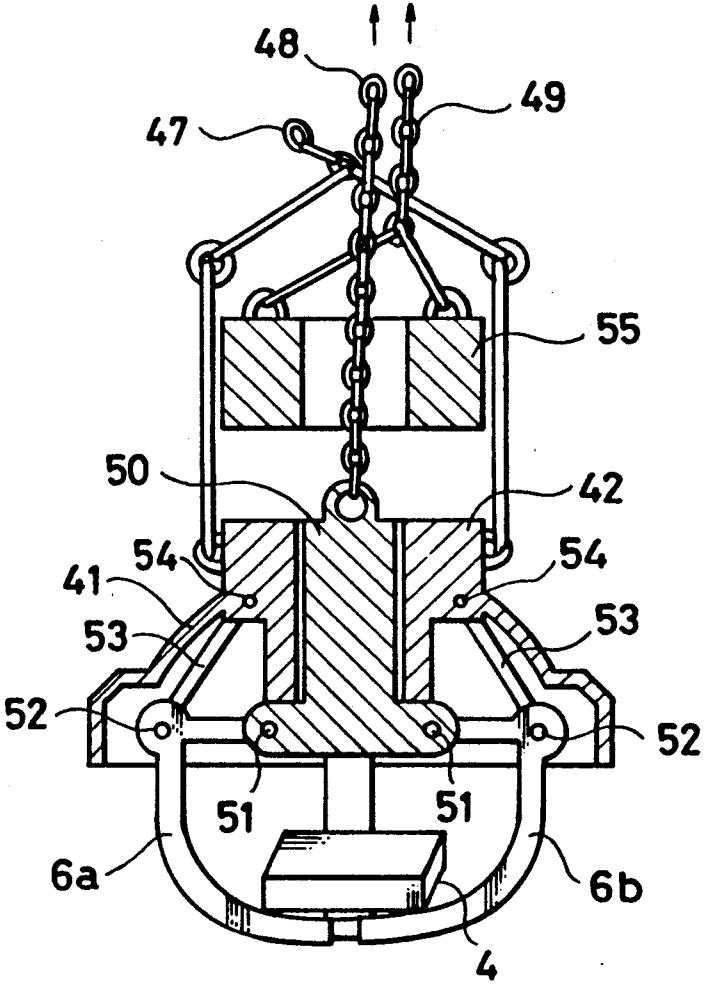
FIGS. 5 and 6 are sectional views showing the action of the crane hooks.
Figure 5A:
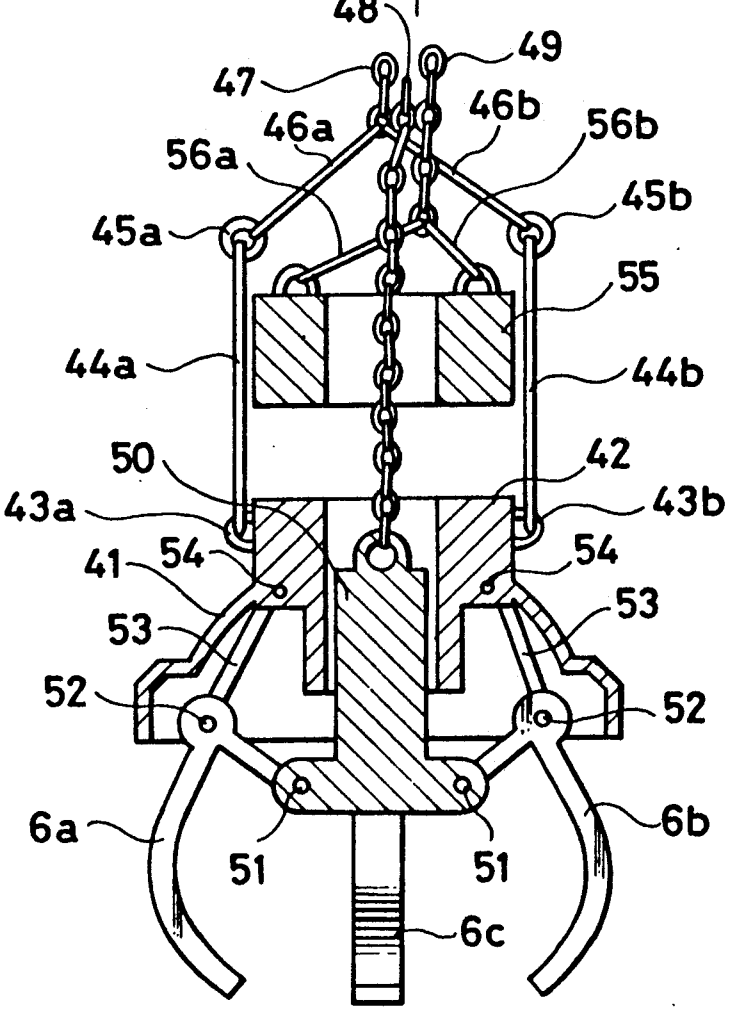

In the state of waiting, the driving mechanism 60 pulls the first chain 47 to keep the crane 5 at the upper position and hangs it down as shown in FIG. 1, while the second chain 48 is not pulled so that the movable member 50 of the crane 5 is positioned down as shown FIG. 5(A) and the hooks 6*a* to 6*d* are opened. The solenoid 70 is not electrically supplied and the plunger 72 is extended as shown in FIG. 7 to add tension to the third chain 49 by the hook 71 of the top, thereby holding the weight member 55 above the casing 41.

In this state, a player inserts a predetermined number of coins into either one of the coin insertion inlets 8 and 9 depending on the corresponding number of games desired to be played.

Then, the player turns the handle 11 to rotate the turntable 3 for bringing a desired premium article among a lot of the premium articles 4 placed on the upper surface of the table right under the crane 5. At this time, the rotation of the handle 11 is communicated to the turntable 3 via the roller 28 consisting of a friction wheel, so that if the handle 11 is rotated quickly or stopped suddenly, the roller 28 is slipped and hence, it becomes difficult to rotate the turn table 3 in accordance with the handle operation. Therefore, the amusement of the game is increased.

When the positioning of the turntable 3 by the handle operation mentioned above is completed, the starter switch 10 is then pushed. Thus, the rotation power unit 61 of the driving mechanism 60 is initiated to rotate the almost L-shaped links 63 and 65. The crane 5 is fallen down by the first chain 47 which hangs down the crane 5. The fall of the crane 5 is continued until the fall of the first chain 47 due to the rotative movement of the second link 65 is stopped. When the fall is stopped, the crane 5 is placed at a position where the hooks 6 can grasp the premium article 4 on the turn table 3. The length of the chains and links and the positions thereof are previously decided so that the almost L-shaped links 63 and 65 pull the second chain 48 instead of the first chain 47 to take up the movable member 50 in the crane 5 and to close the hooks 6*a* to 6*d*. With the rise of the movable member 50, the hooks facing each other are rotatively moved in the direction closing each other to close the hooks 6. Thus, when the premium article 4 is grasped well by the hooks 6, the premium article 4 can be gained.

When the hooks 6 are closed as mentioned above, the crane 5 is then started to rise. This rise is realized by the radially extended lower terminal ends of the movable member 50 taken up by the second chain 48, which then abut on the lower terminal end of the cylindrical portion of the casing 41 as shown in FIG. 5(B) as the rotatively movement of the L-shaped links 63 and 65. Thus, the crane 5 is pulled by the second chain 48 to rise and returns to the initial upper position. When the crane 5 has reached this position the L-shaped links 63 and 65 give a tension to the first chain 47 to hang down the crane 5, while the second chain 48 is placed into a slack state so that the movable member 50 is move downwardly and the hooks 6 are opened. As the result, the premium article, if it is grasped, is dropped down.

Accordingly, when the crane 5 can grasp the premium article with its hooks 6, the player turns the handle 11 to rotate the turntable 3 to bring the opening 33 to right under the crane 5 before the rising crane 5 reaches the upper position. When the operation goes well, by opening the hooks 6, the premium article 4 falls to the passage 35 through the opening 33 of the turntable 3 and the opening 34 of the base 31 and is received by the premium article receptor member 17. Accordingly, the player pulls the grip 19 to uncover the opening 16 of door 7 and can take out the premium article.

Thus, one game is completed. When the player selected one as the number of times of game at the time of coin insertion, the driving mechanism 60 stops in the state where the crane 5 having the hooks opened returns to the upper position. On the other hand, when the plurality number of times of game was selected, the crane 5 and the driving mechanism 60 repeat the above-mentioned actions corresponding times.

The above actions are conducted in the state where the weight member 55 is kept above the casing 41 by giving a tension to the third chain 49. At this time, the premium article grasping force of the hooks is determined by the weight of the casing 41. The reason is as follows: though the hooks 6 of the crane 5 are closed by lifting the movable member 50 up to abut on the casing 41 as shown in FIG. 5(B), in the case where the weight of the premium article, that is, the force to open the hooks, exceeds the force to close the hooks, the hooks 6*a* to 6*d* are opened again by pushing up the casing 41 via the connecting rod 53 of the basic end portion of the hooks 6*a* to 6*d*. When the casing 41 is relatively light, the casing 41 is pushed up with ease correspondingly so the premium article grasping force of the hooks becomes also weak. As the result, even if the hooks grasp the premium article well on the premium article placing face, the probablity of taking up the same is low and the premium article gaining ratio is low.

Figure 6B:
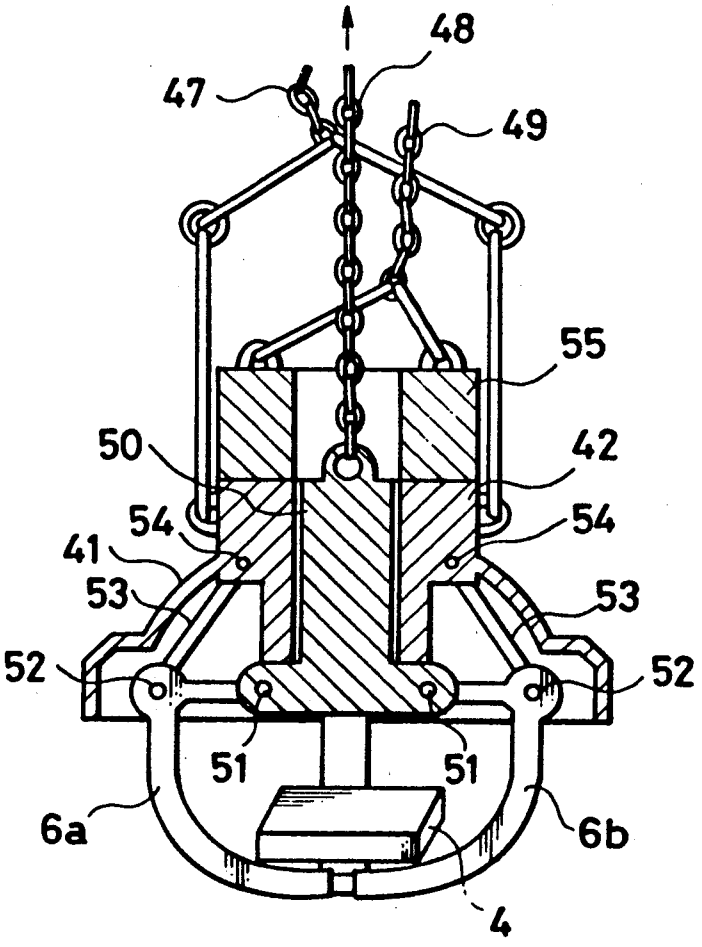
Figure 6A:
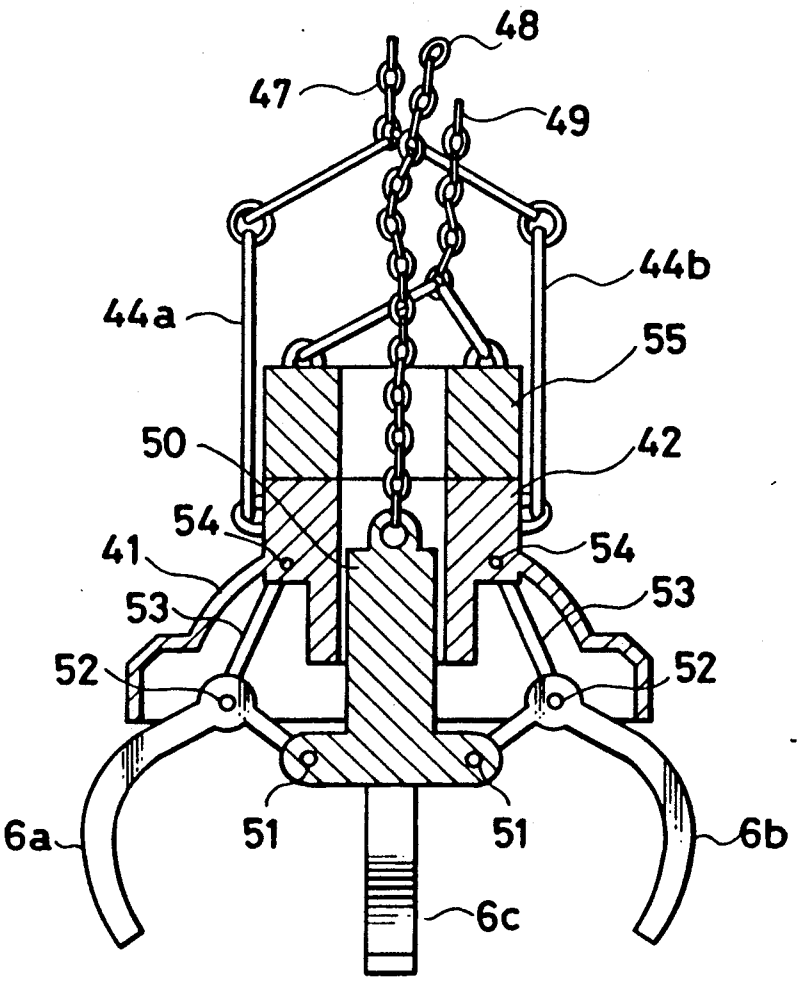

When the hook closing force is increased to heighten the premium article gaining ratio, the weight member 55 is placed on the casing 41 to add the weight by releasing the tension imparted to the third chain 49 in the above-mentioned embodiment. That is, for example, the handler for the crane game machine turns on the electric power switch of the solenoid 70 electrically supply to the solenoid 70, thereby pulling back the plunger 72 to release the tension of the third chain 49. As a result, as shown in FIG. 6(A), there is obtained a state where the weight member 55 is put on the casing 41 to add the weight thereto.

In this state, the player operates the starter switch 10 to initiate the movement of the rotation power unit 61 of the driving mechanism 60. As in the case of FIG. 5, the crane 5 is descended to the position on the premium article placing face to close the hooks 6*a* to 6*d* as shown in FIG. 6(B). When the premium article 4 is grasped well by this action, since the premium article grasping force is increased by the weight of the weight member 55, the probability to take up the premium article 4 becomes larger than in the case of FIG. 5, resulting in high facility of gaining premium article for the player.

As mentioned above, the operation for increasing the ratio of gaining premium article is carried out by driving the solenoid 70 in a ratio of, for example, one tenth or one twentieth, that is, one time per 10 or 20 games. In this case, the solenoid 70 is provided with a drive control circuit to control the electrical supply in above-mentioned ratio.

Figure 8:
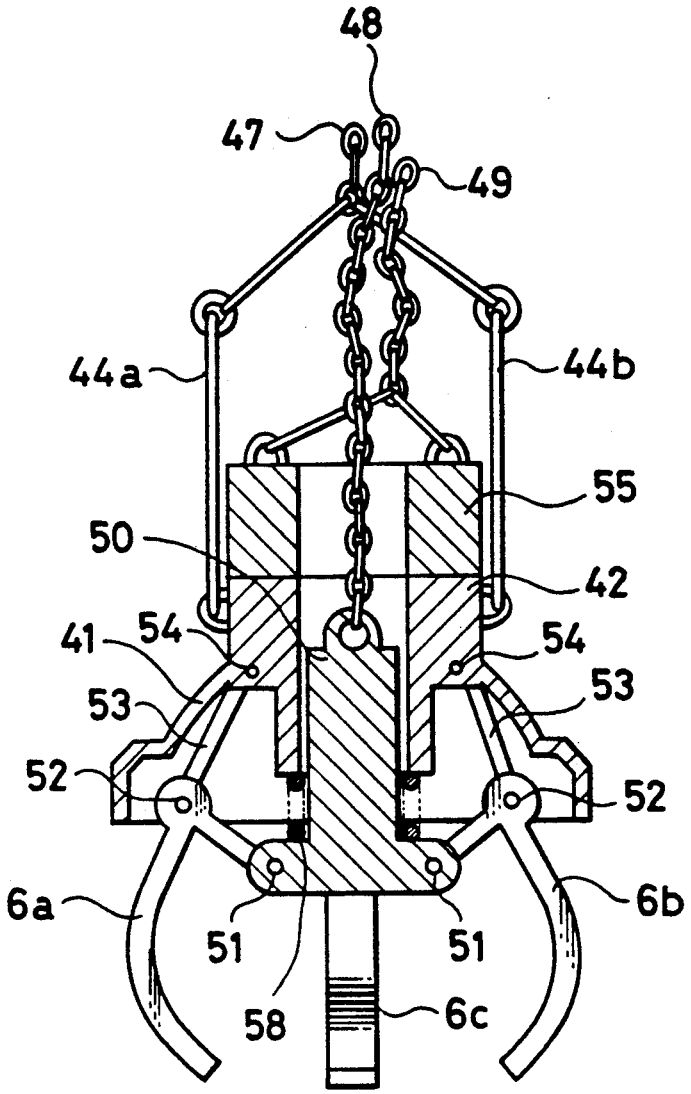
FIG. 8 is a longitudinal sectional view showing another constitution of the crane portion.

Next, FIG. 8 shows a constitution in which in the crane 5 of the above-mentioned embodiment, a spring 58 is interposed between the lower end of the cylindrical portion 42 of the casing 41 and the lower radially extending ends of the movable member 50. In this case, the force for closing the hooks 6*a* to 6*d*, that is, the premium article grasping force can be controlled correpondingly to the elastic force of the spring 58. The premium article grasping force of the hooks can also be regulated by controlling the electric current for driving the solenoid so as to change suitably the tension added to the third chain 49 from the solenoid 70 in FIG. 7.

It is further understood by those skilled in the art that foregoing description is a preferred embodiment of the disclosed invention and that various changes and modifications may be made without departing from the spirit and scope of the invention. For example, the face for putting the premium article is not limited to the disc-type turntable of the embodiment, but it may be a fixed flat board. In this case, the driving mechanism of the crane is constituted so as to translate not only in up and down directions but also forward and backward, and right and left. Also, the grasping force changing means is not limited to those of weight addition system by the weight member as in the embodiment, but it may be one to suitably change the closing force of crane hooks. Further, the means for hanging down the crane can be a rope or other cord besides the chain.

What is claimed is:

1. A crane game machine comprising:

a premium article placing face for putting a large number of premium articles thereon;

a crane having a casing provided with a plurality of hooks being operable and closable for grasping at least one of said premium articles;

a driving mechanism for setting said crane to a position on said premium article placing face and for making said hooks of said crane grasp said premium article in response to a starting operation by an operator;

grasping force changing means for changing premium article grasping force of said crane hooks by applying a load to said casing; and control means for actuating said grasping force changing means at a predetermined ratio, wherein said predetermined ratio is defined as the number of times said grasping force changing means is actuated per number of times said starting operation is commenced.

2. A crane game according to claim 1, wherein the load applied to the casing is a weight.

3. A crane game machine comprising:

a premium article placing face for putting a large number of premium articles thereon;

a crane having a plurality of hooks for grasping at least one of said premium articles;

a driving mechanism for setting said crane to a position on said premium article placing face and for making said hooks of said crane grasp said premium article in response to a starting operation by an operator;

a grasping force changing means for changing premium article grasping force of said crane hooks;

wherein said crane has a casing mounting said hooks for opening and closing movement, a movable member moving up and down to cause the opening and closing movement of said hooks at the underside of said casing and a weight member positioned above said casing; said driving mechanism having links connected to said casing, said movable member and said weight member via a hanger means and a rotation driving means for rotating said links, thereby lifting said movable member via said hanger means to abut on said casing and closing said hooks on said premium article placing face to grasp said premium article, said grasping force changing means including a solenoid which adds a tension to said hanger means connected to said weight member so as to keep said weight member above said casing and which is actuated to release said tension so as to put said weight member on said casing to bring a weight added condition.

4. A crane game machine according to claim 3, wherein said hanger means comprises three chains connected at upper terminals thereof to said link and at lower terminals thereof to said casing, said movable member and said weight member, respectively.

5. A crane game machine according to claim 4, wherein said weight member is formed as a cylinder, through which said chain connected to said movable member is passed.

6. A crane game machine according to claim 3, wherein a spring for regulating said premium article grasping force of said hooks is disposed between said casing and said movable member.

7. A crane game machine comprising:

a premium article placing face for putting a large number of premium articles thereon;

a crane having a casing provided with a plurality of hooks being openable and closeable for grasping at least one of said premium articles, and a movable member moving up and down so as to close and open said hooks at the underside of said casing;

a driving mechanism for setting said crane above said premium article placing face, lifting said movable member to abut against said casing and closing said hooks on said premium article placing face to grasp said premium article;

a grasping force changing means for changing premium article grasping force of said crane hooks, said means including a weight member hung above said casing and a solenoid device which adds a tension to a means for hanging said weight member so as to keep said weight member above said casing when the solenoid is not energized and which is actuated to release said tension so as to put said weight member on said casing to bring a weight added condition when the solenoid is energized, and a control means for actuating said grasping force changing means at a constant probability, said control means including a control circuit for driving said solenoid device at a predetermined ratio.

* * * * *